US012467379B2

(12) United States Patent
Canon

(10) Patent No.: US 12,467,379 B2
(45) Date of Patent: Nov. 11, 2025

(54) PORTABLE FOOT PUMP OPERATED ELECTRIC POWER SOURCE

(71) Applicant: Austin Arnold Canon, Santa Fe, NM (US)

(72) Inventor: Austin Arnold Canon, Santa Fe, NM (US)

( * ) Notice: Subject to any disclaimer, the term of this patent is extended or adjusted under 35 U.S.C. 154(b) by 0 days.

(21) Appl. No.: 18/814,032

(22) Filed: Aug. 23, 2024

(65) Prior Publication Data

US 2025/0075628 A1 Mar. 6, 2025

Related U.S. Application Data

(60) Provisional application No. 63/535,038, filed on Aug. 28, 2023.

(51) Int. Cl.

| | |
|---|---|
| ***F01D 15/10*** | (2006.01) |
| ***F04B 33/00*** | (2006.01) |
| ***F04B 41/02*** | (2006.01) |

(52) U.S. Cl.
CPC ..... *F01D 15/10* (2013.01); *F04B 33/00* (2013.01); *F04B 41/02* (2013.01)

(58) Field of Classification Search
CPC ..... F01D 15/10; F04B 33/00; F04B 41/02
See application file for complete search history.

(56) References Cited

U.S. PATENT DOCUMENTS 5,296,799 A * 3/1994 Davis ..... B60L 50/90 60/412
7,157,802 B2 1/2007 Bodkin
8,890,342 B2 11/2014 Alenezi
2007/0052240 A1 3/2007 Hutchinson et al.
2007/0152448 A1 7/2007 Goldman et al.

FOREIGN PATENT DOCUMENTS

KR 20250070006 A * 5/2025 ..... B63H 11/12
WO WO-2007057914 A1 * 5/2007 ..... F03G 7/00

OTHER PUBLICATIONS

English Translation KR-20250070006-A (Year: 2025).*

* cited by examiner

*Primary Examiner* — Shafiq Mian
(74) *Attorney, Agent, or Firm* — Studebaker Brackett PLLC

(57) ABSTRACT

A portable auxiliary electrical power source is provided having a foot pump that generates compressed air, a frame that supports the foot pump over a floor, and a compressed air cannister that receives, stores, and releases compressed air generated by the foot pump to an electrical power assembly including an air turbine assembly. A control valve controls compressed air from the air cannister to the air turbine assembly, and an electrical generator is mechanically connected to a drive shaft of the air turbine via a gear train. The air cannister is centrally disposed directly beneath the foot pump and forms a load-bearing portion of the frame to minimize the need for frame material, and to provide a compact and stable configuration. The electrical power assembly is positioned in front of the foot pump and under a frame extension to protect it from compressive forces applied to the foot pump. A two-stage axial air turbine is used in the air turbine assembly.

20 Claims, 10 Drawing Sheets

PORTABLE FOOT PUMP OPERATED ELECTRIC POWER SOURCE

RELATED APPLICATIONS

This application claims priority from U.S. provisional application No. 63/535,038 filed Aug. 28, 2023.

FIELD OF THE INVENTION

This invention generally relates to portable electric power supplies, and is specifically concerned with a foot pump powered electric power supply particularly adapted for emergency use.

BACKGROUND OF THE INVENTION

Foot and hand operated auxiliary electrical power supplies are known in the prior art. In some designs, a foot pedal rotates the shaft of an electrical generator via a gear train to generate electricity. In other designs, a foot pump supplies compressed air to a compressed air reservoir which in turn operates a pneumatically powered electrical generator. This design has the advantage of being able to supply electricity without the need for a simultaneous foot operation by merely releasing previously accumulated compressed air. In still another design, a hand-crank operated generator recharges rechargeable batteries for later use, thereby obviating the need for any mechanical work to be simultaneously performed for auxiliary power to be available.

SUMMARY OF THE INVENTION

While such foot and hand operated electrical power supplies can provide useful amounts of electrical power during a power grid failure or the like, the applicant has noted a number of shortcomings in the previous designs that compromise their reliability, efficiency, and portability. For example, in designs where a foot pump supplies compressed air to a compressed air reservoir which in turn operates a pneumatically powered generator, the foot pump is mounted on top of a housing that includes not only the pneumatically operated electrical generator, but also a relatively delicate air turbine assembly, gear train, and various electrical output sockets, connectors, and pressure gauges. Such a configuration mandates the provision of a strong and consequently heavy frame to protect these relatively delicate parts as they are always directly exposed to the load applied to the foot pump during a pumping operation. Also, the positioning of the compressed air reservoir to one of the sides of the foot pump and generator housing results in a sprawling configuration that compromises portability. In designs employing a hand-crank operated generator, efficiency is compromised as much more energy can be generated without fatigue via a foot pump versus a hand crank.

Hence there is a need for a foot pump operated power source having a compact configuration without the need for a large amount of heavy frame materials to protect the relatively delicate air turbine assembly, gear train, and various electrical output sockets, connectors, and pressure gauges from compressive forces during pumping. To this end, the inventive foot pump operated electric power source comprises a foot pump that generates compressed air; a frame that supports the foot pump over a floor; a compressed air cannister that receives, stores, and releases compressed air generated by the foot pump; an electrical power assembly including an air turbine assembly driven by a flow of compressed air from the air cannister, and an electrical generator having a driven shaft mechanically connected to a drive shaft of the air turbine assembly, and a pressure control assembly including a control valve that controls the flow of compressed air to the air turbine assembly, wherein (1) the compressed air cannister is disposed directly beneath the foot pump and forms a load-bearing portion of the frame to enhance compactness and stability; (2) the electrical power assembly is positioned in front of the foot pump to avoid the compressive forces applied to the foot pump, and (3) a portion of the frame extends beyond the foot pump to protect the electrical power assembly from any compressive loads applied as a result of an accidental misstep during a pumping operation.

The combination of these three structural features provides a compact foot pump operated power source having a frame that robustly protects its delicate components with a minimum amount of frame materials. Additionally, the central positioning of the compressed air cannister (which is the heaviest single component of the power source) directly under the foot pump allows the power source to maintain a stable and stationary position on the floor during the pumping operation, thereby enhancing the efficiency of the pumping operation and reducing the chances of a misstep.

While a radial air turbine assembly may be used, an axial air turbine assembly having a two-stage turbine is much preferred for its higher efficiency in converting the flow of compressed air into mechanical energy that drives the electrical generator.

BRIEF DESCRIPTION OF THE SEVERAL FIGURES

Figure 4A:
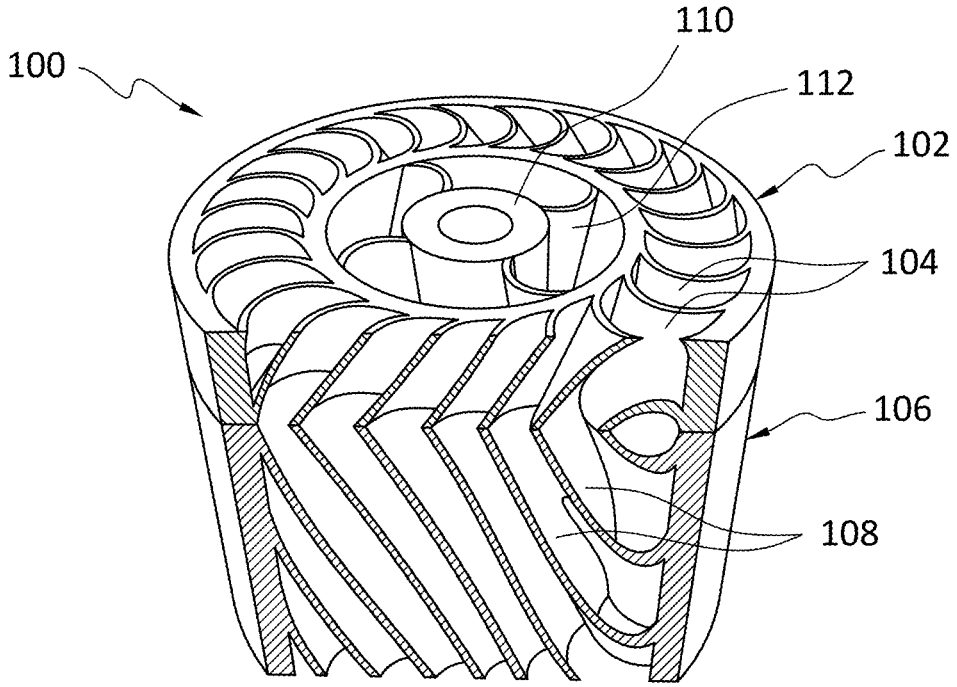
FIG. 4A is a perspective, sectional view of the two-stage turbine used in the most preferred embodiment of the invention.
Figure 4B:
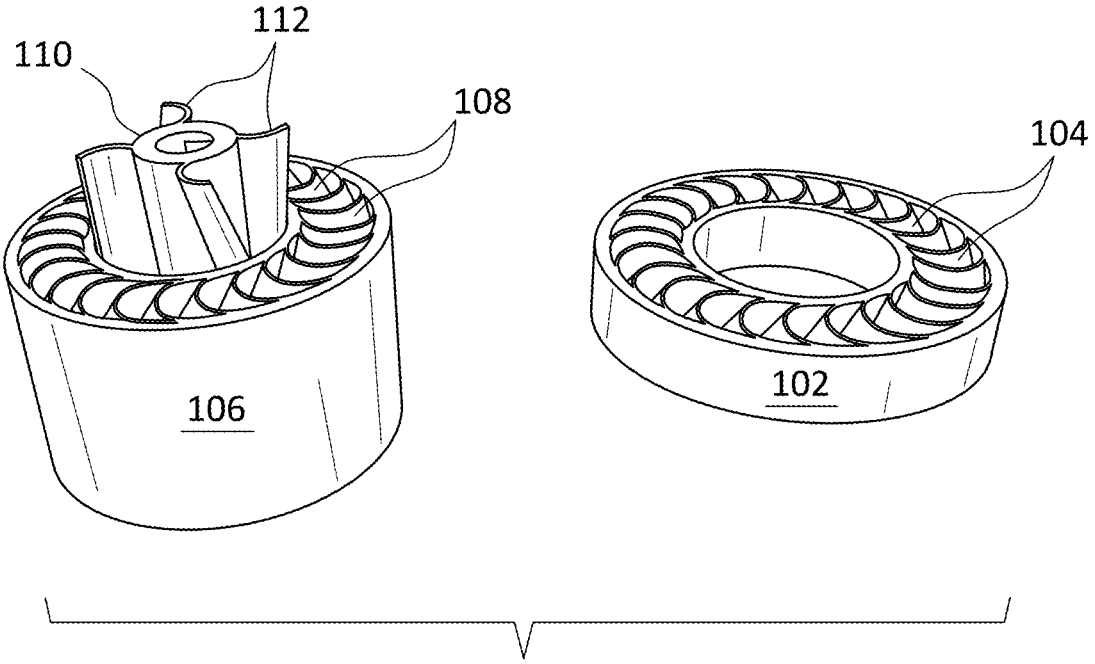
Figure 4C:
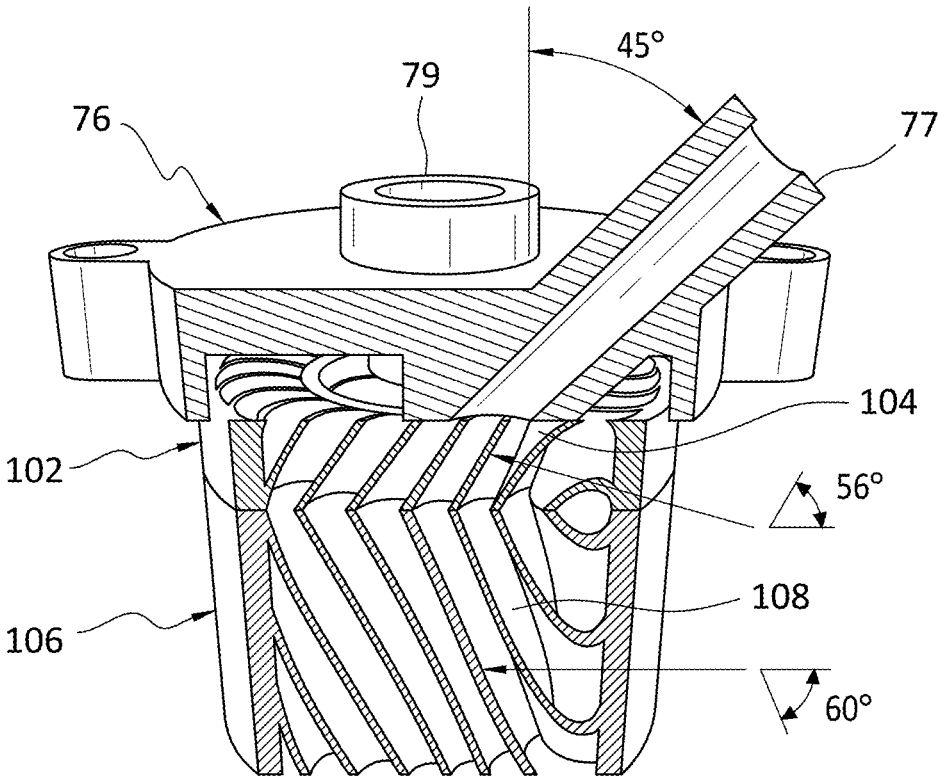

FIG. 4B is a perspective sectional view of the two-stage turbine of FIG. 4A shown with the two turbine stages separated from one another, and FIG. 4C is a perspective, sectional view of the two-stage turbine of FIG. 4A shown in combination with a sectional perspective view of the inlet cap to illustrate the angle of impingement between the air flow from the inlet and the blades of the first and second stages of the turbine.

DETAILED DESCRIPTION OF A PREFERRED EMBODIMENT

Figure 1A:
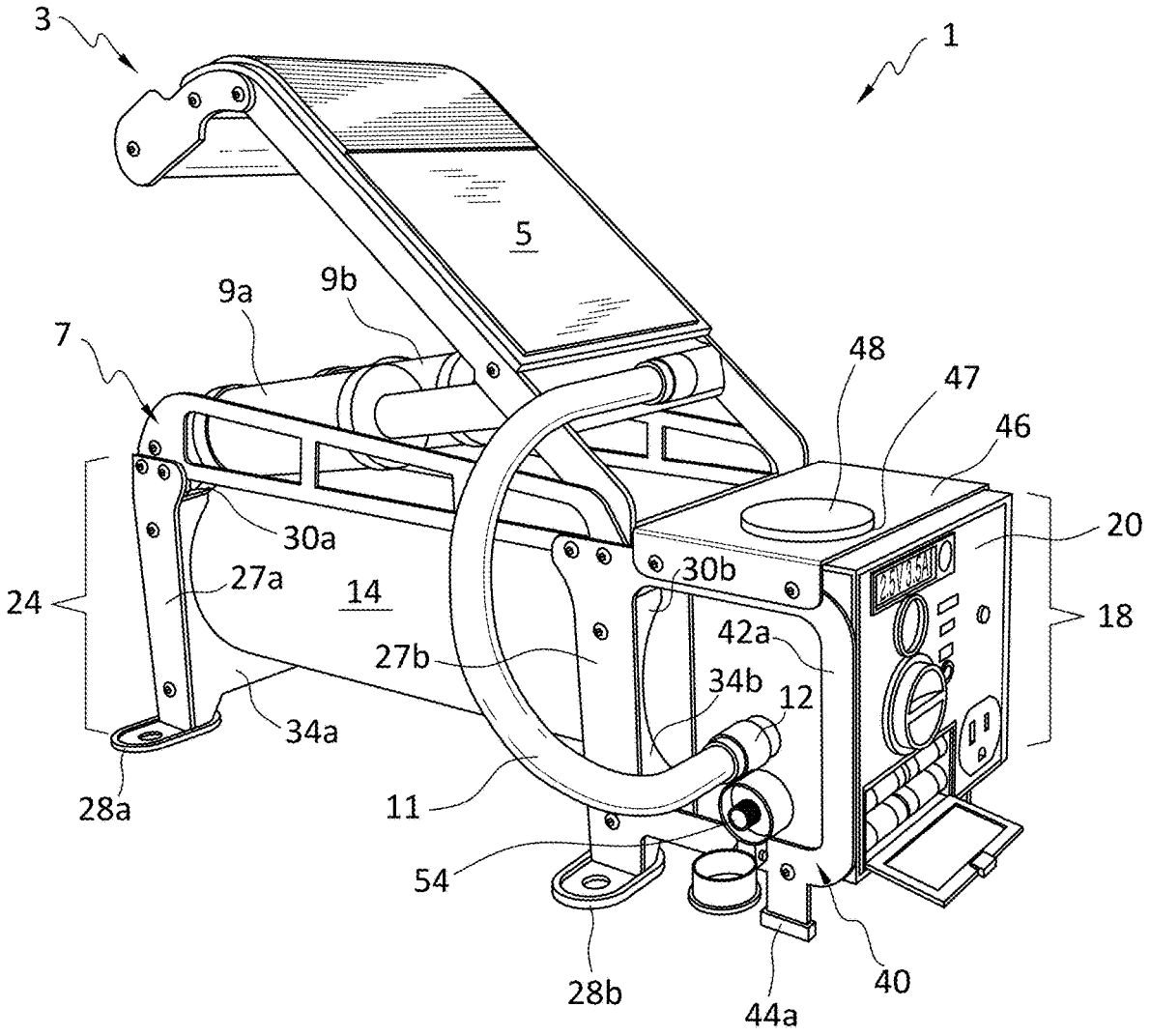
FIG. 1A is a perspective view of the foot pump operated electric power source.
Figure 1B:
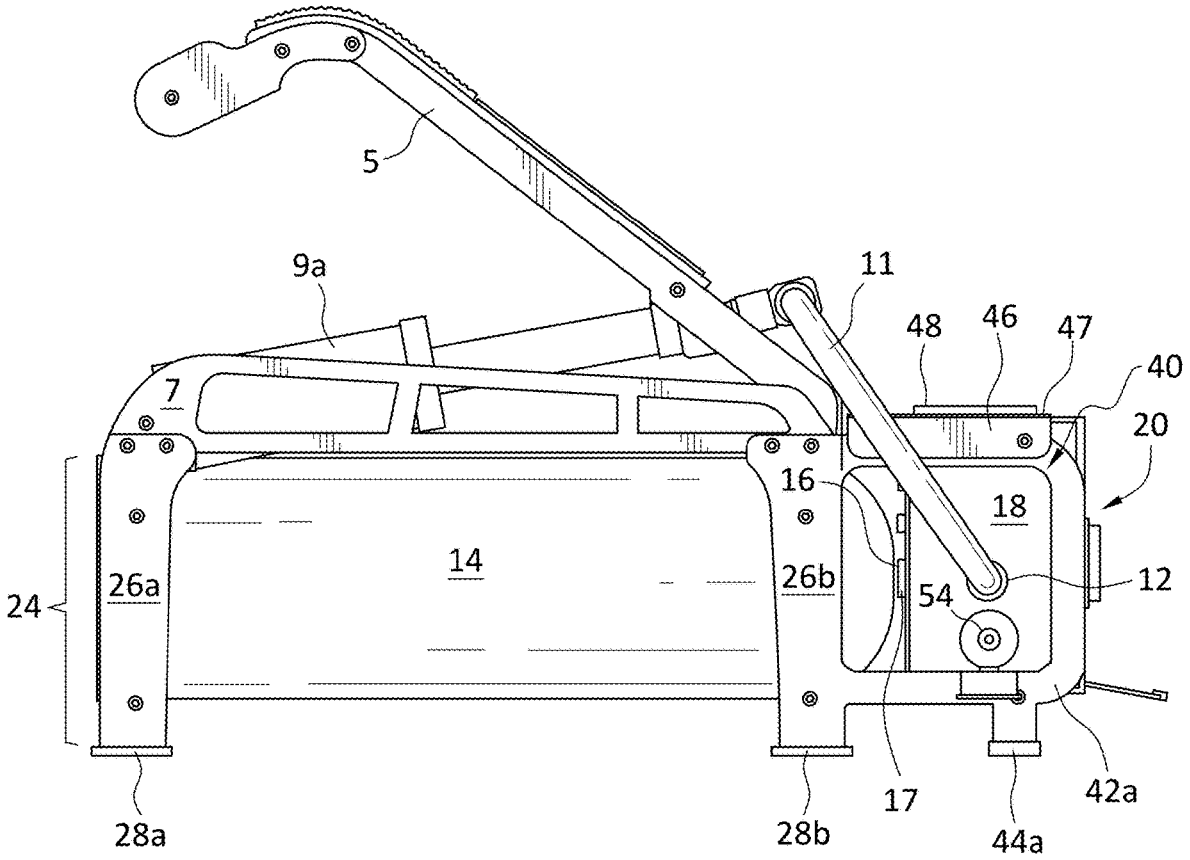
FIGS. 1B and 1C are a side and a rear view of the electric power source illustrating how the frame transmits a load from the foot pump through the air cannister to the floor.

As shown in FIGS. 1A and 1B, the portable, foot pump operated electric power source 1 of the invention comprises a foot pump 3 mounted over a pressurized air cannister 14, and a housing 18 containing an electric power assembly 20. A frame 24 unitizes these components such that the air cannister 14 is directly under the foot pump 3, with the housing 18 in front of the foot pump 3 as shown. A frame extension 40 surrounds and protects the housing 18 from missteps by an operator.

The foot pump 3 may be a commercially available, foot-operated pump of the type having a pedal 5 pivotally mounted onto a pump frame 7 and linked to a pair of compression cylinders 9*a*, 9*b* as shown. An outlet hose 11 terminating in a screw coupling directs compressed air generated by the cylinders 9*a*, 9*b* into the air cannister 14 via the housing 18. As is best seen in FIG. 1B, the air cannister 14 has a threaded coupling 16 at its proximal end that screws into a threaded inlet 17 of the housing 18. Preferably, the air cannister has a capacity of at least 2 liters.

The unitizing frame 24 includes four load-bearing legs 26*a-d* (of which only legs 26*a*, 26*b*, and 26*d* are visible). The top portion of each leg 26*a-d* is attached to the foot pump frame 7. The bottom portion of each leg 26*a-d* terminates in a foot 28*a-d* extending outwardly in a sideways direction in order to widen the contact between the frame 24 and the supporting floor. Such a sideways extending configuration of the feet 28*a*-28*d* provides more stability to the frame 24 during a pumping operation. Preferably, each foot 28*a-d* is covered by a non-skid material such rubber to provide a gripping force between the frame 24 and the supporting floor.

Figure 1C:
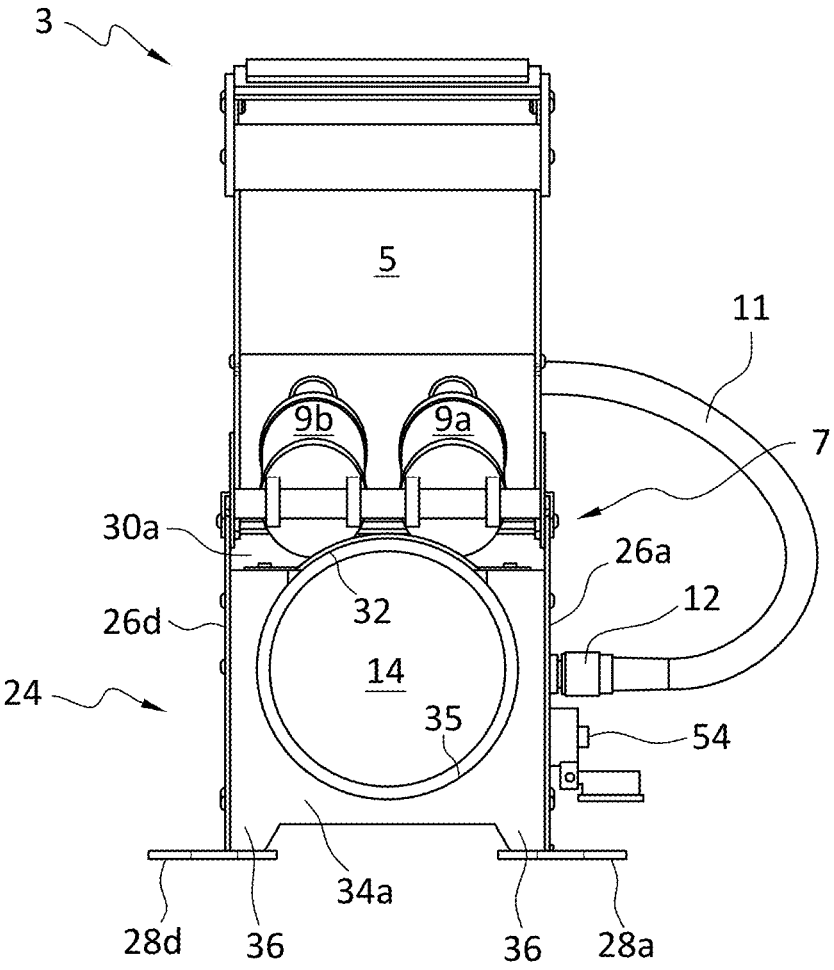

With reference now to FIG. 1C, frame 24 further includes proximal and distal upper frame plates 30*a* and 30*b*, the top surfaces of which contact the pump frame 7, the bottom surfaces of which each include an arcuate recess 32. Recesses 32 are both complementary in shape to, and in load bearing engagement with, the cylindrical side walls of the air cannister 14. These proximal and distal upper frame plates 30*a* and 30*b* are stacked over proximal and distal lower frame plates 34*a* and 34*b* as shown. Lower frame plates 34*a* and 34*b* each include C-shaped recess that is both complementary in shape to, and in load bearing engagement with, the cylindrical side walls of the air cannister 14. Lower frame plates 34*a* and 34*b* each also include lower side portions 36 that terminate on the top surfaces of the feet 28*a-d*. Hence a load applied to the pedal 5 of the foot pump 3 will be conducted from the frame 7 of the foot pump 3 to the feet 28*a-d* of the frame 24 not only through the four load-bearing legs 26*a-d*, but also through the air cannister 14 via the upper and lower frame plates 30*a*, 30*b*, and 34*a*, 34*b*.

The positioning of the air cannister 14 directly beneath the foot pump 3 with its longitudinal axis in alignment with the longitudinal axis of the foot pump frame 7 advantageously exploits the weight of the air cannister to stabilize the power source 1 during a pumping operation, thereby increasing the efficiency of the air charging operation. The use of the air cannister 14 as a load-bearing member of the frame 24 provides a stronger frame and further increases stable support for the foot pump-operated electric power source 1 during a foot pumping operation. It also allows the four load-bearing legs 26*a-d* and other frame members to be made lighter, thereby reducing the weight and improving the portability of the power source 1.

With reference again to FIGS. 1A and 1B, the frame 24 further includes a frame extension 40 that extends in front of the foot pump 3. The frame extension 40 includes a pair of opposing side support plates 42*a*, 42*b* that terminate in a further pair of feet 44*a*, 44*b*. A top plate 46 extends over and interconnects the side support plates 42*a*, 42*b*. An opening 47 is provided in the top plate 46 for the display dial of a pressure gauge 48. The frame extension 40 receives the housing 18 of the electric power assembly 20 and protects the relatively delicate electrical components from being accidentally crushed by the foot of an operator of the power source 1.

When the foot pump 3 is being used correctly, no significant mechanical load is applied to the housing 18 of the electrical power assembly 20 since it is not located under the foot pump 3 and since it forms no part of the load bearing path from the pedal 5 to the frame feet 28*a-d*. However, in the event that an operator of the power source 1 should accidentally step on the housing 18 during pumping, the resulting mechanical load would be borne by the frame extension 40 and not by the housing 18. Such a load would be transmitted around housing 18 from the top plate 46 through the side support plates 42*a*, 42*b* and finally through the feet 44*a*, 44*b* of these plates.

Figure 2A:
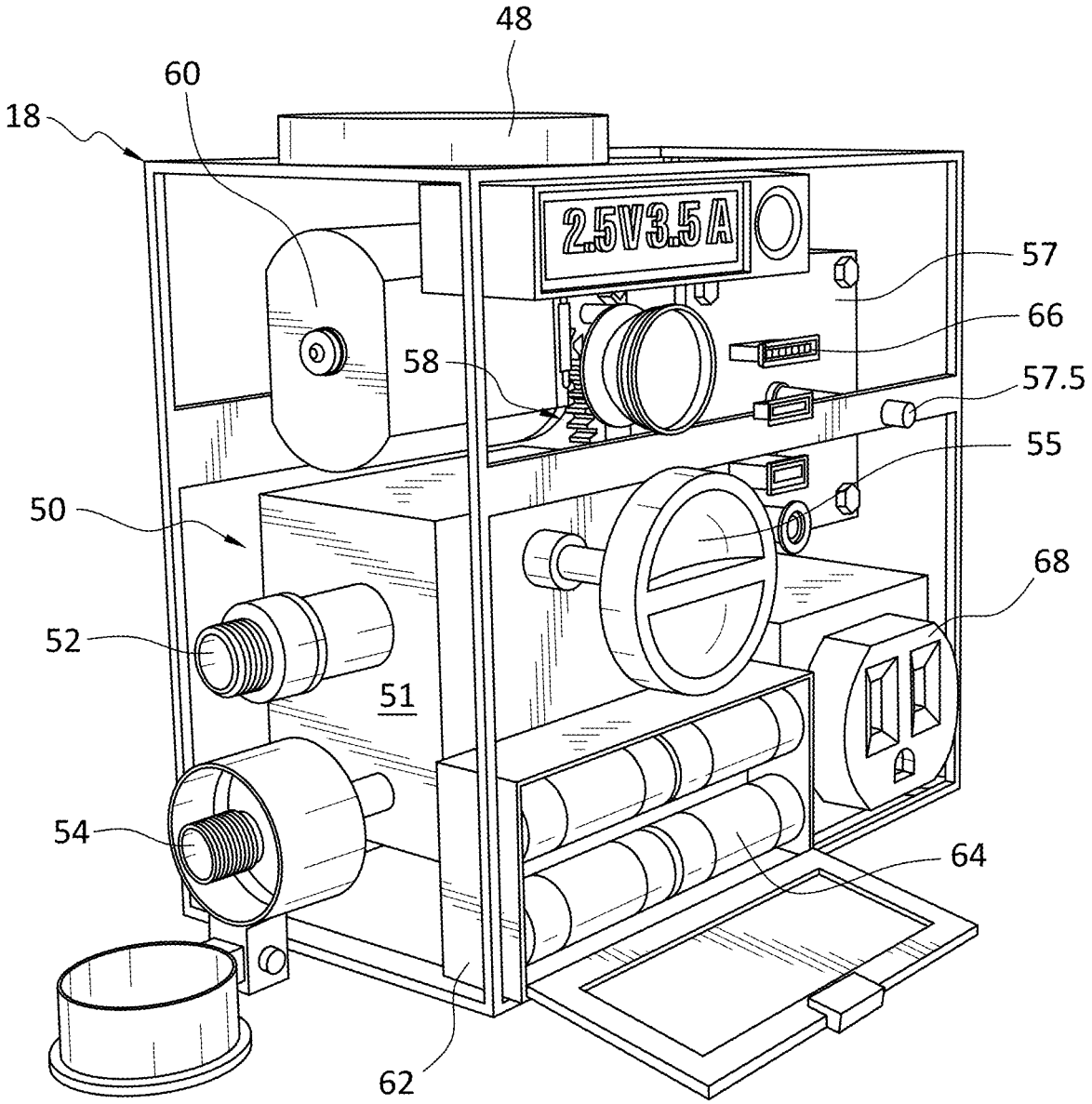
FIGS. 2A and 2B are left and right-side perspective views of the electric power source with the housing containing the electric power and pressure control assemblies removed.
Figure 2B:
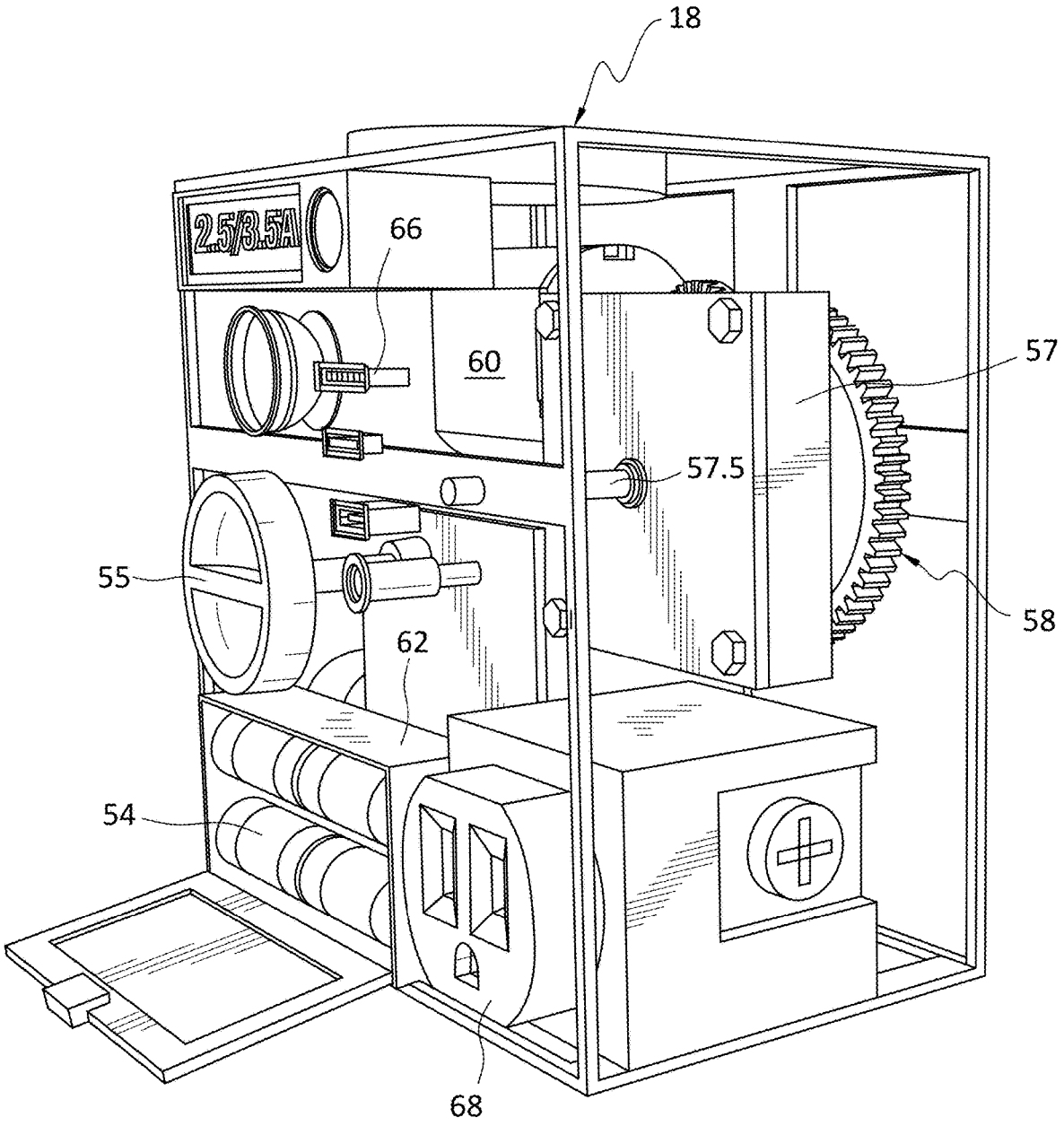

FIGS. 2A and 2B illustrate the components of the electric power assembly 20 contained within the housing 18, which include a compressed air controller 50, a control valve 51 that controls a flow of compressed air from the air cannister 14 through a radial air turbine assembly 57, a gear train 58, and an electrical generator 60.

The compressed air controller 50 includes a rectangular housing 51 having a threaded inlet 52 that is connected to the screw coupling 12 of the outlet hose 11 of the foot pump 3. Threaded inlet 52 is connected to a check valve (not shown) so that compressed air from the foot pump 3 cannot leak back through the outlet hose 11. The housing 51 further has a Schrader valve 54 that allows the air cannister 14 to be filled with compressed air from an outside source such as the air compressors used to fill automotive tires at gas stations. Housing 51 also includes a control valve 55 for controlling a flow of compressed air out of the housing 51 via an outlet (not shown) to a radial air turbine assembly 57. Such air turbine assemblies 57 contain a rotor (not shown) having blades in a paddle-wheel type configuration that convert pneumatic power to rotary mechanical power. Pressure gauge 48 communicates with the compressed air inside the housing 51 to display the pressure of the air within it.

The radial air turbine assembly 57 has an output shaft 57.5 that is connected to an input shaft (not shown) of a gear train 58 best seen in FIG. 2B. An output shaft of the gear train 58 is in turn connected to an input shaft of an electric generator 60. The electrical output of the generator 60 is connected to a battery charger 62 having rechargeable batteries 64. The electrical output of the generator 60 is also connected in parallel to one or more USB outlets 66 and a DC outlet 68.

In operation, the air cannister 14 of the electric power source 1 is charged with compressed air by repeatedly stepping on the spring-loaded pedal 5 of the foot pump 3. As previously mentioned, the positioning of the air cannister 14 directly beneath the foot pump 3 with its longitudinal axis in alignment with the longitudinal axis of the foot pump frame 7 advantageously exploits the weight of the air cannister to stabilize the power source 1 as an operator steps on the foot pump pedal 5, thereby maintaining the frame 24 securely in place during the air charging operation. Stabilization is further enhanced by the use of the air cannister 14 as a load-bearing member of the frame 24 that transmits the load applied to the pedal 5 of the air pump 3 directly to the skid-resistant feet 28*a-d* of the frame 24 to the floor via the upper and lower frame plates 30*a*, 30*b*, and 34*a*, 34*b* that support the foot pump frame 7 and clampingly engage the cylindrical walls of the air cannister 14. The air cannister 14 should be charged to a pressure of around 160 psi, and the location of the pressure gauge 48 on the top plate 46 of the frame extension 40 allows the operator to easily see when the charging procedure is complete.

In the event that the operator of the electric power source 1 should misstep onto the housing 18 of the electric power assembly 20, the frame extension 40 transmits the errant load around the housing 18 from the top plate 46 through the side support plates 42*a*, 42*b* and finally through the feet 44*a*, 44*b* of these plates.

The provision of the battery charger 62 advantageously allows the power source 1 to store power for later use, thereby obviating the need to use the foot pump 3 in real time whenever electricity is needed.

Figure 3A:
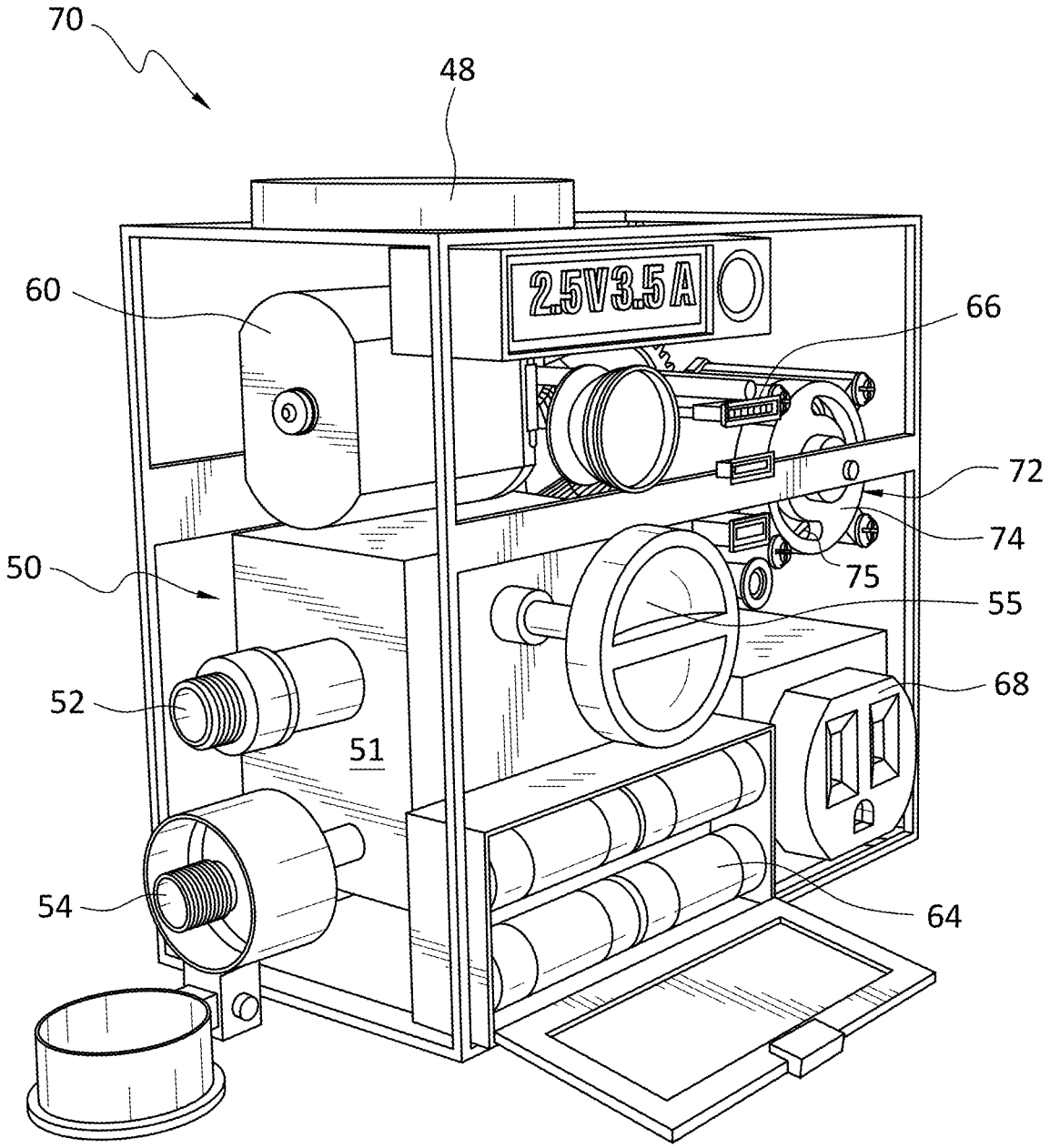
FIGS. 3A and 3B are a perspective and a side view, respectively, of a second embodiment of the foot pump operated electric power source that employs an axial air turbine assembly.
Figure 3B:
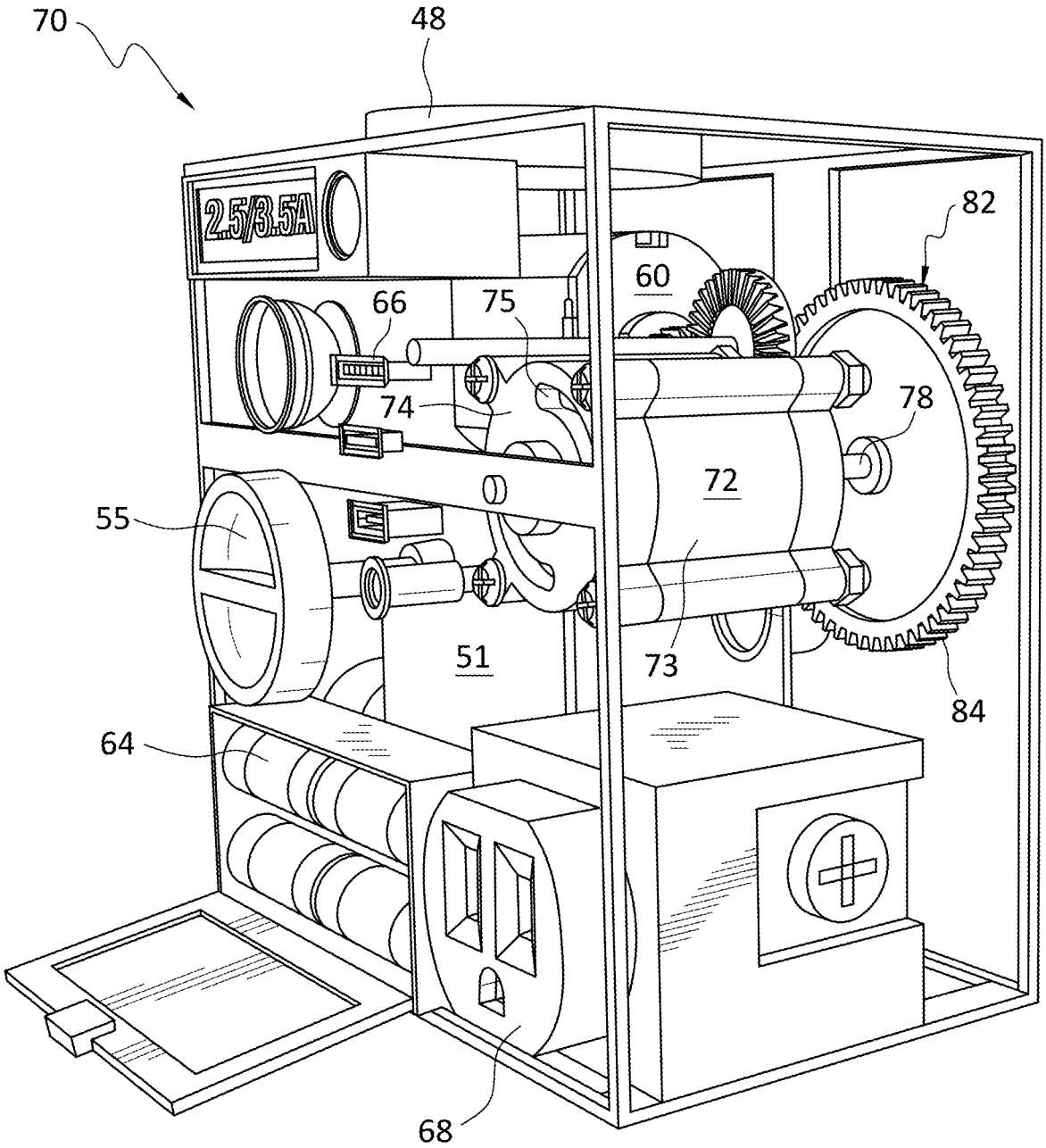
Figure 3C:
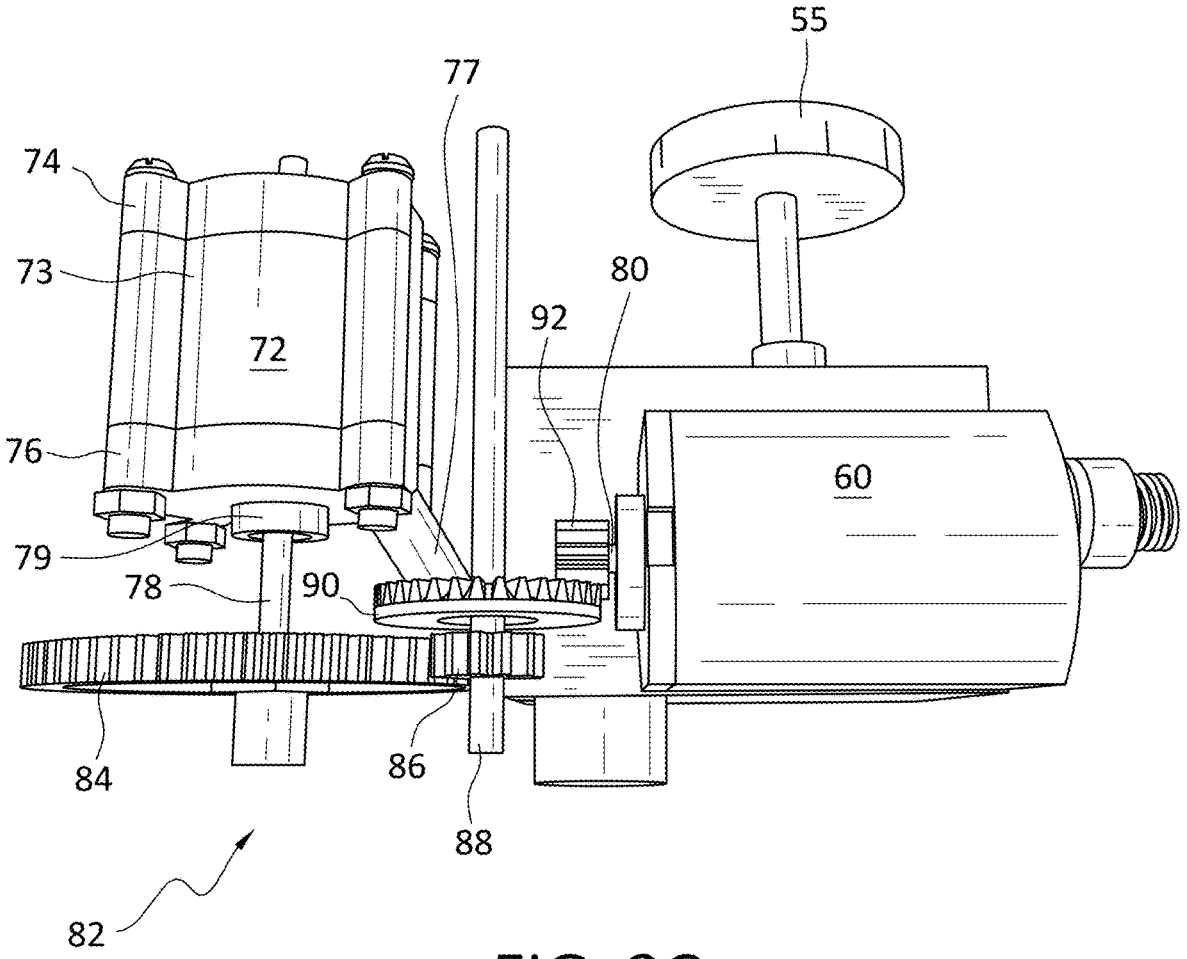
FIG. 3C is a top view of the axial air turbine assembly, the electrical generator, and the drive train therebetween.

FIGS. 3A-3C illustrate a second preferred embodiment 70 of the portable, foot pump operated electric power source of the invention. The second preferred embodiment is the same in structure and operation as the first embodiment 1 with the exception that an axial air turbine assembly 72 is used instead of a radial air turbine assembly 57. The axial air turbine assembly 72 has a mid-housing 73, an outlet cap 74 having air outlets 75, and an air inlet cap 76 having an air inlet 77 tilted at a 45° angle connecting the assembly 72 to an outlet (not shown) of the housing 51 of the compressed air controller 50. The mid-housing 73 contains a two-stage air turbine 100 (shown in FIGS. 4A-4C) mounted in concentric relationship to a rotatable output shaft 78. In contrast to the paddle-wheel type rotor used in a radial air turbine assembly wherein the blades are approximately orthogonal to the direction of the flow of compressed air, the air turbine 100 includes blades pitched at an angle to the direction of the flow of compressed air. Applicant has observed that such an axial air turbine assembly 72 is up to five times more efficient than a radial air turbine assembly 57 in converting pneumatic power from the compressed air from the air cannister 14 to mechanical power turning the input shaft of the electrical generator 60.

With specific reference to FIG. 3C, the output shaft 78 of the axial air turbine 72 is rotatably mounted to a bearing 79 concentrically located on the air inlet cap. Output shaft 78 is coupled to the input shaft 80 of the electric generator 60 via drive train 82. In this particular embodiment, the drive train 82 includes drive gear 84 connected to the output shaft 78 of the axial air turbine, which meshes with a smaller driven gear 86 that is connected to rotatable shaft 88. A bevel gear 90 that is likewise connected to shaft 88 meshes with a smaller bevel gear 92 connected to the generator input shaft 80.

FIGS. 4A-4C illustrate the structural details of the air turbine 100 responsible for the high efficiency in converting the pneumatic energy of the compressed air from the rectangular housing 51 of the compressed air controller 50 to mechanical energy that drives the electrical generator 60. As shown in FIGS. 4A and 4B, air turbine 100 includes an inlet turbine section 102 having blades 104, and an outlet turbine section 106 having blades 108. While the two turbine sections 102 and 106 are illustrated separately in FIG. 4B, this is done simply to more clearly illustrate the structure of each section, as the two sections 102, 106 are in fact a one-piece component manufactured by, for example, 3-D printing. A shaft coupling 110 that fixedly connects the turbine 100 to the output shaft 78 is concentrically disposed along the axis of rotation of the turbine 100. Four turbine blades 112 integrally connect the inlet and outlet turbine sections 102 and 106 to the coupling 110. As is best seen in FIG. 4C, the blades 104 of the inlet turbine section 102 are pitched at about a 56° angle relative to a plane that is orthogonal to the axis of rotation of the turbine 100, while the blades 108 of the outlet turbine section 106 are pitched at about a 60° angle relative to such a plane in a direction opposite to the pitch of the blades 104.

In operation, a flow of compressed air from the air cannister 14 flows through the air inlet 77 of the inlet cap 76 impinges first on the blades 104 of the inlet turbine section 102. Due to the 45° tilt of the air inlet 77, the air flowing through out of the inlet 77 strikes more blades 104 due to the oblong shape of the interface between the inlet 77 and the wall of the inlet cap 76. Additionally, because of the 45° angle of the air flow and the 56° angle tilt of the blades 104 relative to a plane orthogonal to the axis of rotation of the turbine, the angle of impingement is only about 11°. However, as the air flows through the inlet turbine section 102 and impinges on the blades of the outlet turbine section 106, the angle of impingement transitions to about 64°. It should be further noted that the axial length of the outlet blades 106 is about three times longer than the axial length of the inlet blades 104. Hence most of the impingement occurs at about a 64° angle, which more efficiently captures the energy of the air stream than the initial 11° impingement angle. Applicant believes that the initial 11° impingement angle afforded by the blades 104 of the inlet turbine section 102 avoids turbulent air flow associated with the 90° impingement angle afforded by radial type air turbine assemblies 57 by providing an intermediate impingement step between the initial air flow and the final air flow through the turbine 100. This 11° transitioning advantageously promotes laminar air flow throughout both sections 102, 106 of the axial turbine 100. Such laminar flow is much more efficient in converting the pneumatic energy of the compressed air flow to mechanical energy that drives the electrical generator 60 and is a primary factor why the two-stage axial turbine 100 effectively captures up to five times more kinetic energy from the compressed air stream than a radial turbine assembly 57. The 11° initial impingement angle and the 64° final impingement angle are merely exemplary, and similar results can be obtained with an initial impingement angle of between about 7° and 15°, and a final impingement angle of between about 58° and 70°.

While this invention has been described with respect to two different embodiments, the invention itself is not confined to these examples. Many variations and alternative embodiments will occur to persons of skill in the art. For example, the frame 24 may be configured such that the bottom of the air cannister 14 directly engages the ground, thereby utilizing the cannister to provide a larger and more direct load bearing portion of the frame 24. All such variations and alternative embodiments are included within the scope of this invention, which is limited only by the appended claims and their equivalents.

The invention claimed is:

1. A portable auxiliary electrical power source, comprising:

a foot pump that generates compressed air;

a frame that supports the foot pump over a floor;

a compressed air cannister that receives, stores, and releases compressed air generated by the foot pump;

an electrical power assembly including an air turbine assembly having a control valve that controls a flow of compressed air from the compressed air cannister to the air turbine assembly, and an electrical generator having a driven shaft mechanically connected to a drive shaft of the air turbine assembly, wherein the compressed air cannister is disposed directly beneath the foot pump and forms a load-bearing portion of the frame.

2. The portable auxiliary electrical power source defined in claim 1, wherein the electrical power assembly is positioned in a portion of the frame extending to one side of the foot pump.

3. The portable auxiliary electrical power source defined in claim 1, wherein the electrical power assembly is positioned in a portion of the frame extending in front of the foot pump that isolates it from a load applied to the foot pump during a pumping operation.

4. The portable auxiliary electrical power source defined in claim 3, wherein a central axis of the compressed air cannister is aligned with a central axis of the foot pump.

5. The portable auxiliary electrical power source defined in claim 1, wherein the compressed air cannister transmits the load applied to the foot pump to the floor.

6. The portable auxiliary electrical power source defined in claim 1, wherein the frame includes a plurality of floor-engaging portions disposed on either side of the compressed air cannister.

7. The portable auxiliary electrical power source defined in claim 1, wherein the electrical power supply further includes a battery charger and electrical sockets, each of which is connected in parallel to an output of the electrical generator such that electrical power may be drawn from recharged batteries in the battery charger when the control valve is closed, or from the electrical sockets when the control valve is open.

8. The portable auxiliary electrical power source defined in claim 7, wherein the electrical power supply includes an axial air turbine assembly.

9. The portable auxiliary electrical power source defined in claim 1, further comprising a pressure gauge for displaying a pressure of the air cannister.

10. The portable auxiliary electrical power source defined in claim 1, further comprising a valve for filling the air cylinder from a source of compressed air other than the foot pump.

11. A portable auxiliary electrical power source, comprising:

a foot pump that generates compressed air;

a frame that supports the foot pump over a floor;

a compressed air cannister that receives, stores, and releases compressed air generated by the foot pump;

an electrical power assembly including an air turbine assembly having a control valve that controls a flow of compressed air from the compressed air cannister to the air turbine assembly, and an electrical generator having a driven shaft mechanically connected to a drive shaft of the air turbine assembly, wherein the compressed air cannister forms a load-bearing portion of the frame that transmits a load applied to the foot pump to the floor, and wherein the electrical power assembly is positioned in a portion of the frame extending in front of the foot pump that isolates it from a load applied to the foot pump during a pumping operation.

12. The portable auxiliary electrical power source defined in claim 11, wherein the compressed air cannister is disposed directly beneath the foot pump.

13. The portable auxiliary electrical power source defined in claim 12, wherein a central axis of the compressed air cannister is aligned with a central axis of the foot pump.

14. The portable auxiliary electrical power source defined in claim 11, wherein the foot pump includes a pivotally-mounted pedal moveable between an angle of about 0° to 55°.

15. The portable auxiliary electrical power source defined in claim 14, wherein the frame includes a plurality of floor-engaging portions disposed on either side of the compressed air cannister and the pivotally-mounted pedal of the foot pump.

16. The portable auxiliary electrical power source defined in claim 11, wherein the electrical power assembly further includes a battery charger and electrical sockets, each of which is connected in parallel to an output of the electrical generator such that electrical power may be drawn from recharged batteries in the battery charger when the control valve is closed, or from the electrical sockets when the control valve is open.

17. The portable auxiliary electrical power source defined in claim 16, wherein the electrical power assembly further includes a two-stage axial air turbine assembly.

18. The portable auxiliary electrical power source defined in claim 11, further comprising a pressure gauge for displaying a pressure of the air cannister.

19. The portable auxiliary electrical power source defined in claim 18, wherein the pressure gauge is mounted on a top wall of the frame so as to be visible to a person operating the foot pump.

20. The portable auxiliary electrical power source defined in claim 11, further comprising a valve for filling the air cylinder from a source of compressed air other than the foot pump.

* * * * *